US005433281A

United States Patent [19]

Black

[11] Patent Number: 5,433,281

[45] Date of Patent: Jul. 18, 1995

[54] ROOF DRILL BIT TIP

[76] Inventor: Stanton Black, 111 S. Spring Valley Rd., McMurray, Pa. 15317

[21] Appl. No.: 280,337

[22] Filed: Jul. 25, 1994

[51] Int. Cl.[6] ..... E21B 10/58
[52] U.S. Cl. ..... 175/420.1
[58] Field of Search ..... 175/420.1, 415, 426, 175/427

[56] References Cited

U.S. PATENT DOCUMENTS 5,172,778 12/1992 Tibbitts et al. ..... 175/420.1
5,269,387 12/1993 Nance ..... 175/420.1

*Primary Examiner*—William P. Neuder
*Attorney, Agent, or Firm*—William J. Ruano

[57] ABSTRACT

A roof drill having a drill bit tip including a plurality of equally spaced, V-shaped serrations.

2 Claims, 1 Drawing Sheet

ROOF DRILL BIT TIP

BACKGROUND OF THE INVENTION

Current roof drill tip designs, as shown in FIG. 1, achieve penetration by rotating a fairly flat cutting surface that shaves or carves away the material being drilled. This action can create extremely high bit tip temperatures caused by friction that lead to premature bit tip failure.

This shaving or carving action by this fairly flat cutting surface can produce extremely fine dust particles.

SUMMARY OF THE INVENTION

The present improved roof bit tip design achieves faster penetration by incorporating "V" shaped grooves into the cutting surface of the drill bit tip, thereby creating a chipping action that serves to lower bit tip temperatures and prolonging bit tip life by reducing the friction caused by the shaving or carving action. This chipping action also produces larger dust particles which creates a more favorable environment.

DESCRIPTION OF THE PREFERRED EMBODIMENT

Figure 1:
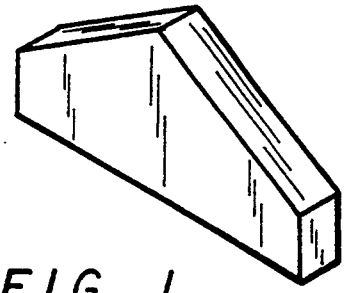
FIG. 1 is a perspective view of a conventional roof drill bit tip.
Figure 2:
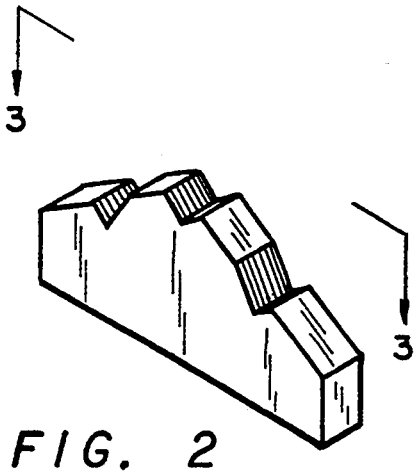
FIG. 2 is a perspective view of the roof drill bit tip of the present invention.
Figure 3:
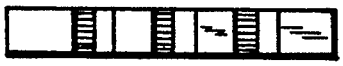
FIG. 3 is a top view taken along line 3—3 of FIG. 2.
Figure 4:
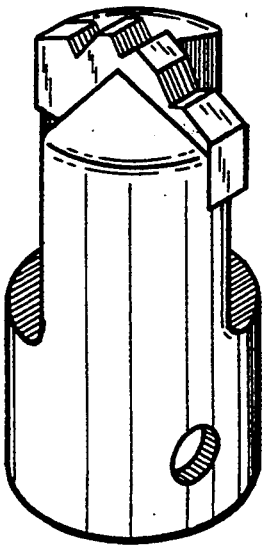
FIG. 4 is a perspective view of a roof drill bit incorporating the drill bit tip of the present invention shown in FIGS. 2 and 3.

Referring to FIGS. 2 and 3, which show the drill bit design of the present invention, it will be noted that it includes a plurality of V shaped serrations into the upper cutting surface to achieve faster penetration and creating a chipping action that serves to lower bit tip temperatures and prolonging bit tip life by reducing the friction caused by the shaving or carving action.

This chipping action alos produces larger dust particles which create a more favorable environment.

I claim:

1. A roof drill having a drill bit tip with a plurality of V shaped serrations in its cutting surface.

2. A roof drill as recited in claim 1 having an inverted V-shape cutting surface including a V shaped serration at the apex of the inverted V shape and a V shaped serration on each side of said apex, equally spaced from said apex.

* * * * *